United States Patent [19]

Lee

[11] 3,952,560

[45] Apr. 27, 1976

[54] PADLOCK WITH BUMPER

[75] Inventor: Lurk Ming Lee, Hong Kong, Hong Kong

[73] Assignee: Po Wah Company, Hong Kong, Hong Kong

[22] Filed: Aug. 4, 1975

[21] Appl. No.: 601,472

[52] U.S. Cl. ..... 70/52; 70/54

[51] Int. Cl.[2] ..... E05B 67/02

[58] Field of Search ..... 70/52, 54, 55, 56, 51, 70/DIG. 34, DIG. 43, DIG. 56; 40/2.2, 20, 21; 292/DIG. 73

[56] References Cited

UNITED STATES PATENTS

| | | | |
|---|---|---|---|
| 2,662,385 | 12/1953 | Favoico | 70/52 |
| 3,453,758 | 7/1969 | Soref | 70/54 X |
| 3,783,657 | 1/1974 | Foote | 70/52 |

FOREIGN PATENTS OR APPLICATIONS

| | | | |
|---|---|---|---|
| 494,178 | 3/1930 | Germany | 70/52 |

*Primary Examiner*—Robert L. Wolfe
*Attorney, Agent, or Firm*—J. B. Felshin

[57] ABSTRACT

This invention relates to padlocks. The padlock comprises a plurality of superimposed metal plates arranged one on top of the other and bolted together. A decorative bumper band surrounds a group of said plates spaced from the lowermost and uppermost of said plurality of plates. The end plates of said group of plates are formed with projections received in notches at the upper and lower perimetric edges of the band to hold the band in place.

15 Claims, 8 Drawing Figures

PADLOCK WITH BUMPER

Padlocks of which the bodies thereof are constructed of layers of metal (preferably steel) plates arranged one on top of the other and bolted together, are well known. It is also known to provide about the body or a part of the body of such a padlock a decorative bumper band, for example of a plastics material. When such a band is provided the problem arises as to how the band should be most conveniently secured into place.

An object of the present invention is to provide a padlock of the character described, the body of which is constructed of a plurality of superimposed plates, wherein a decorative bumper band extends around at least some of the superimposed plates, the decorative band being secured in position by means of projections on some of the plates which are arranged and adapted to engage recesses formed in the band.

In a particular preferred arrangement it is the two plates, the respective planes of which coincide with the planes defined by the two perimetric edges of the band, which engage with the perimetric edges in the manner according to the invention. Preferably the projections are provided on the plates and the corresponding recesses are provided in the band. More preferably there are two projections on each of the longer sides of each of the two plates and there are two corresponding recesses formed in each of the longer sides of each of the two perimetric edges of the band.

Another object of this invention is to provide a strong and durable padlock of the character described which shall be easy to assemble, inexpensive to manufacture and which shall yet be practical and efficient to a high degree in use.

The manner according to the invention of securing the decorative band to the body of the padlock is cheap and easy to manufacture.

The invention will be further described by way of example only, with reference to the accompanying drawings, in which.

Figure 1:
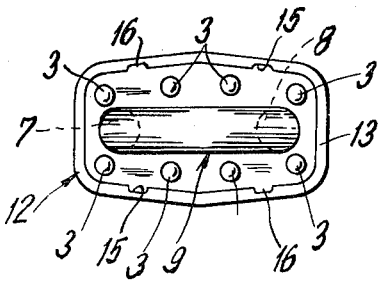
FIG. 1 is a top view of padlock according to the invention provided with a decorative band around a part of the body thereof.
Figure 2:
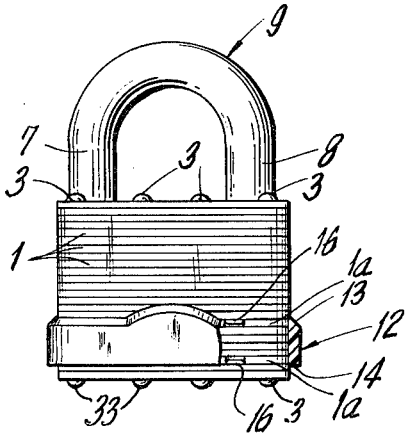
FIG. 2 is a side view, partly cut away and partly in section, of the padlock shown in FIG. 1.
Figure 3:
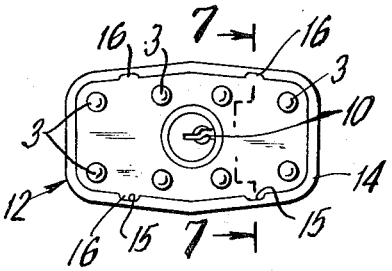
FIG. 3 is a bottom view of the padlock shown in FIGS. 1 and 2.

The padlock shown in FIGS. 1 to 3 generally comprises a plurality of superimposed steel plates 1 each provided with eight holes 2 through which extend bolts 3 for the purpose of the securing of the plates 1 together to form a unitary body of the padlock. Each plate 1 is further provided with three aligned larger holes 4, 5 and 6. The holes 4 and 6 are for receiving the respective limbs 7 and 8 of a generally U-shaped locking member 9 and the holes 5 are for receiving a key (not shown) which may be inserted through a keyhole 10 in the bottom of the padlock for releasing and securing the locking member 9. The holes 4 and 5 in each of the plates 1 are interconnected by a channel 11. The bottom end plate of the stack comprising the body of the padlock is not provided with the holes 4, 11 and 6.

Figure 4:
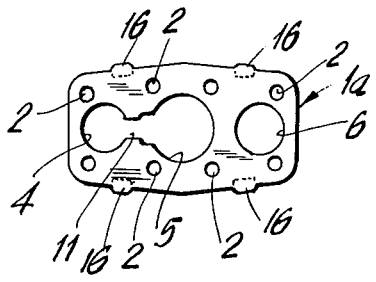
FIG. 4 is a plan view of one of the plates from which the body of the padlock shown in FIGS. 1 to 3 is constructed.
Figure 5:
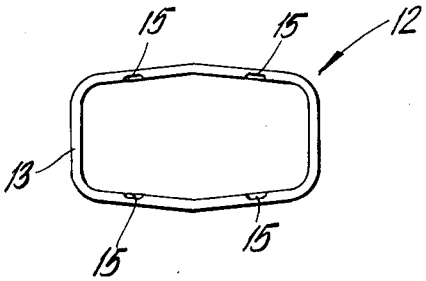
FIG. 5 is a plan view of the decorative band fitted around the body of the padlock as shown in FIGS. 1 to 3.
Figure 6:
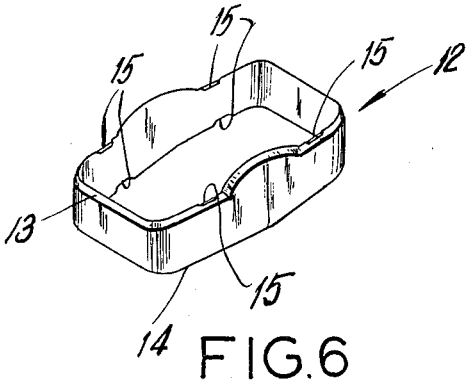
FIG. 6 is a perspective view of the decorative band shown in FIG. 5.
Figure 7:
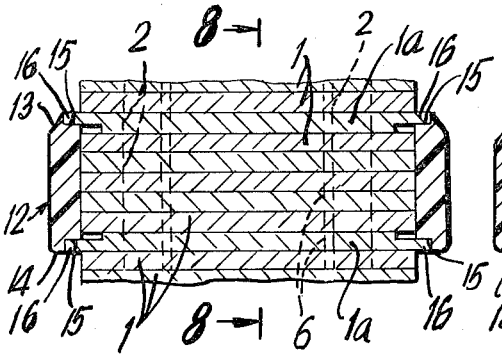
FIG. 7 is a cross-sectional view taken on line 7—7 of FIG. 3.
Figure 8:
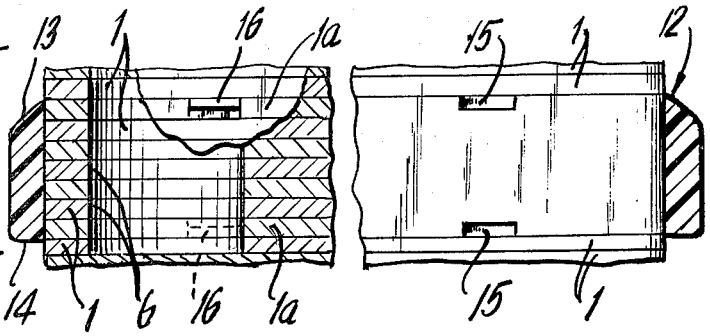
FIG. 8 is a cross-sectional view taken on line 8—8 of FIG. 7.

Around a part of the body of the padlock, i.e. around some only of the plates comprising the body of the padlock, is provided a decorative band 12, which is more clearly shown in FIGS. 5 and 6. The decorative band 12 is preferably of plastics material. The two perimetric edges 13 and 14 of the decorative band are each provided with recesses 15 which are engaged by projections 16 provided on the two plates, the respective planes of which coincide with the planes defined by the two perimetric edges 13 and 14 of the decorative band. The two plates which engage and retain the decorative band in this manner are indicated by reference numeral 1*a* in FIG. 2; one such plate is shown in more detail in FIG. 4.

As shown in the drawings, it is preferred that two projections 16 are provided on each of the longer sides of each of the plates 1*a* and that two corresponding recesses 15 are formed in each of the longer sides of each of the perimetric edges 13 and 14 of the band 12. However, it will be appreciated that other arrangements of projections and recesses may be employed. In particular the projections could be provided on the decorative band 12 and the recesses formed in the steel plates 1*a*.

The projections 16 may be made by die stamping the plates 1*a* to reduce the thickness of the plates and to extend the projections outwardly. The projections 16 do not pass through the entire thickness of the band and the band extends outwardly beyond the projections so that no part of the projections project beyond the outer surface of the band. The band thus is a bumper at its outer surface, all around. The recesses 15 at the upper and lower perimeters of the band open inwardly. The recesses at the upper perimetric edge of the band open upwardly. The recesses at the lower perimetric edge of the band open downwardly.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. A padlock comprising a body, said body comprising a plurality of superimposed metal plates, a band of material softer than the metal of said plates, surrounding a group of said plates, one or more of the plates of said group being provided with one or more projections, and said band having perimetric upper and lower edges and being formed with recesses receiving said projections, to retain the band in place on said body.

2. The combination of claim 1, said one or more plates comprising upper and lower end plates of said group.

3. The combination of claim 2, said end plates of said group, coinciding with upper and lower perimetric edges of said band.

4. The combination of claim 3, said recesses being located at said perimetric edges of said band.

5. The combination of claim 4, said recesses at the upper perimetric edge of said band opening upwardly, and said recesses at the lower perimetric edge of said band opening downwardly.

6. The combination of claim 5, said projections terminating inwardly of the outer surface of said band.

7. The combination of claim 1, said plurality of plates including plates disposed beyond the perimetric upper and lower edges of said band.

8. The combination of claim 1, said recesses opening inwardly of the inner surface of said band.

9. The combination of claim 1, said plurality of plates including plates disposed beyond the perimetric upper and lower edges of said band.

10. The combination of claim 9, said recesses opening inwardly of the inner surface of said band.

11. The combination of claim 10, said one or more plates comprising upper and lower end plates of said group.

12. The combination of claim 11, said end plates of said group, coinciding with upper and lower perimetric edges of said band.

13. The combination of claim 12, said recesses being located at said perimetric edges of said band.

14. The combination of claim 13, said recesses at the upper perimetric edge of said band opening upwardly, and said recesses at the lower perimetric edge of said band opening downwardly.

15. The combination of claim 14, said projections terminating inwardly of the outer surface of said band.

* * * * *